US005609390A

United States Patent [19]

Takafuji

[11] Patent Number: 5,609,390

[45] Date of Patent: Mar. 11, 1997

[54] HEIGHT-ADJUSTABLE FOLDING CHAIR

[75] Inventor: Hirosuke Takafuji, Osaka, Japan

[73] Assignee: Seiko Industrial Corporation, Osaka-fu, Japan

[21] Appl. No.: 524,435

[22] Filed: Sep. 6, 1995

[30] Foreign Application Priority Data

Sep. 6, 1994 [JP] Japan ..... 6-239610

[51] Int. Cl.[6] ..... A47C 4/00

[52] U.S. Cl. ..... 297/55; 297/338

[58] Field of Search ..... 297/55, 22, 23, 297/52, 338, 331, 335, 344.12, 344.14, 377

[56] References Cited

U.S. PATENT DOCUMENTS

| | | | |
|---|---|---|---|
| 2,697,480 | 12/1954 | Du Bois et al. | 297/338 |
| 2,843,182 | 7/1958 | Stallard | 297/338 |
| 3,181,828 | 5/1965 | Cramer | 297/338 X |
| 3,656,809 | 4/1972 | Ronning | 297/338 X |
| 4,148,523 | 4/1979 | Brand et al. | 297/55 |
| 4,793,654 | 12/1988 | Takafuji . | |

FOREIGN PATENT DOCUMENTS

| | | | |
|---|---|---|---|
| 111090 | 3/1989 | Japan . | |
| 2226950 | 7/1990 | United Kingdom | 297/338 |

*Primary Examiner*—Laurie K. Cranmer
*Attorney, Agent, or Firm*—Browdy and Neimark

[57] ABSTRACT

A height-adjustable folding chair comprising a main frame, an auxiliary leg foldably connected to the main frame and a seat mounted on the main frame. The main frame has a pair of left and right poles and lateral bars bridged between the poles. The seat has hooks at rear end thereof for hooking to the lateral bar, and the seat has abutting members at portions near the rear end thereof for abutting against the poles.

12 Claims, 14 Drawing Sheets

HEIGHT-ADJUSTABLE FOLDING CHAIR

BACKGROUND OF THE INVENTION

The present invention relates to a height-adjustable folding chair.

There has been, hitherto, known a height-adjustable folding chair which has a main frame and a height-adjustable seat (U.S. Pat. No. 4,793,654). The main frame is made of a large U-shaped metal pipe and a small U-shaped metal pipe arranged in the large metal pipe with remaining vertically extending gaps. The seat has vertical plates ends of which are inserted through the vertically extending gaps and stoppers made of hard-rubber mounted on a shaft connecting left and right vertical plates at rear ends thereof mutually or projecting to the left and right sides so that the stoppers abut against the front surfaces and rear surfaces of the metal pipes of the main frame.

The chair is comfortable to sit on since the stoppers function as cushions, and the seat is continuously adjustable at any height. However, the seat is held with friction force caused by abutting the stoppers against the surfaces of pipes. Therefore, though the seat can be securely fixed to the main frame when a user sits on it, the seat might slip down when no user sits on it and an upward force is applied at the front end of the seat, since the leverage function and the friction are cancelled.

In order to delete the problem, another chair having many engaging projections capable of engaging with the stoppers at the rear surfaces of the pipe of the main frame is proposed (cf. JIKKO Hei 1-11090, Japanese Utility Model Examined Publication No. 11090/1989).

In this chair, such risk that the seat slips down is relatively small when the front end of the seat is pulled up in some extent. However, when the seat inclines to an extent, the stopper disengages from the engaging projections and the seat slips down to engage with the next projection. Further, in the worst case, the seat might fall down from the main frame.

In addition, in the above known chairs, the height-adjustable area of the seat is limited to an area upper than the connecting portion of an auxiliary leg since the auxiliary leg is rotatably connected with the main frame at a middle portion thereof. Therefore, the seat cannot be set at a lower height. Further, when the chair is folded, the seat is mounted on the main frame with the under surface out. Therefore, the mounted seat is not stable and appearance of the chair is not undesirable when it is folded.

An object of the present invention is a height-adjustable chair in which user feels comfortable to sit on, seat is hard to slip out of the main frame, and adjustable height area is wide.

Another object of the present invention is a height-adjustable chair which has good appearance when it is folded.

Further another object of the present invention is a chair pertinent to hand work, in which angle of the seat is adjustable in accordance with height of the seat or in accordance with posture of the user.

SUMMARY OF THE INVENTION

According to the present invention, a height-adjustable folding chair is provided which comprises a main frame having at least a pair of left and right supporting poles and plural lateral bars bridged between the supporting poles, an auxiliary leg foldably connected to the main frame, and a seat detachably mounded on the main frame. The seat has a hook to be hooked to one of the lateral bars at rear end thereof and has an abutting portion for abutting against the surface of the vertical bars so that the seat hooked with the lateral bar can be supported in horizontal angle. Further, the chair has means for hanging the seat member on the main frame.

The abutting portion has preferably an elastomeric member made of synthetic resin or rubber. Further, the seat has preferably a framework and a seat body attached on the framework, in which the framework has a pair of left and right supporting bars extending front-and-rear direction and lateral members connecting the supporting bars. Each supporting bar has preferably the hook at a rear end thereof. The supporting bar has preferably a vertical rib having a hook at an rear end thereof and a horizontal rib to which the seat body is attached, so that the supporting bar has an L-shaped or T-shaped cross section. Further, the seat has preferably a lateral rod which passes the left and right vertical ribs at lower portions so that both free ends of the lateral rod project from the vertical ribs, in which the elastomeric abutting members are fixed on the projecting free ends. Further, a reinforcing bar is preferably bridged between the rear ends of the vertical ribs in order to reinforce the hooks.

The above-mentioned hanging means preferably comprises the hook of the seat and a hanging bar fixed at the back of the main frame for hanging the hook of the seat. The hanging means can be a combination of the lateral bars of the main frame and a second hook attached to the seat such that the seat can be hung along the main frame by hooking the second hook to one of the lateral bars. In this case, the second hook is further preferably attached to the seat in rotatable manner.

The above-mentioned seat body is preferably mounted on the framework through an elastic member which allows inclination of the seat body to the framework. The upper portion of the main frame is preferably bent forward slightly. The lower ends of the left and right supporting poles of the main frame are preferably bent in diagonally forward directions.

In use position of the chair, the auxiliary leg is opened from the main frame. Then the chair can be stood in such posture that the supporting poles are slanted in the front down.

Next, the seat is arranged at the front side of the main frame and is held in substantially right angle to the supporting pole, namely so that the seat is slanted in the rear down. Then the hook of the rear end is hooked to a lateral bar, and the seat is rotated in the front down to abut the abutting member against the surface of the supporting pole. Then, the user can sit on the seat. In this state, if the front end of the seat receives an upward force or, if the front end is somewhat lifted, the seat might rotate about the lateral bar and comes back to stable position soon, since the hook is securely engaged with the lateral bar. Therefore, the seat do not slip down nor disengage from the main frame.

In folded position, the seat is detached from the main frame in converse manner of the above-mentioned use position. And the seat is hung on the main frame by means of the hanging means of the main frame and the seat. In this state, the auxiliary leg is folded against the main frame to obtain flat state of the chair.

In a chair in which the main frame has a hanging bar for hanging the hook of the seat, the seat can be hung on the main frame with the upper surface of the seat faces out.

Namely, the under surface abuts against the main frame. Therefore, good appearance can be obtained in folded position.

In another chair in which the seat has a second hook, the seat can be hung at front side or rear side of the main frame by hooking the second hook on any one of the lateral bars. In another chair in which the second hook is rotatably jointed to the seat, the second hook can come back inside when the seat drops down erroneously. Therefore, the second hook can be protected. In a chair in which the seat has a vertical ribs and a lateral rod passing through the vertical ribs and the seat has a reinforcing bar, the hooks are strong against lateral force and are hard to be bent.

In case that the hook or hooks curves down and curves further forward, the hook is hard to slip down from the lateral bar, when the seat is supported in horizontal posture by hooking the hook of the seat. In this state, only the abutting member are abutted against the front surface of the main frame. Therefore, when the abutting member is made of an elastomeric material such as rubber or synthetic resin, the main frame is not injured, and good appearance is maintained. In addition, good cushion effect can be obtained, and the chair is comfortable to sit on.

In a chair in which lateral bars are arranged to the lower portion of the main frame, the seat can be set at the lower position.

In a chair in which a seat body is attached to the framework through an elastic member which allows inclination of the seat body, the seat body can incline in accordance with position of the gravity center of the user. Therefore, work efficiency of the user is improved in sitting state.

In a chair in which upper portion of the main body inclines forward in some angle, the seat inclines forward al so when the seat is set to the upper port ion. Therefore work efficiency is improved. Further, in a chair in which lower ends of the vertical member are bent forward and out, the seat is stably mounted when the seat is set at the lower portion of the main body, since center of gravity of the user falls at back side of the front ends of the supporting poles.

Hereinafter, referring to the attached drawings, several preferred embodiments of the present invention are described.

DETAILED DESCRIPTION OF THE INVENTION

Figure 1:
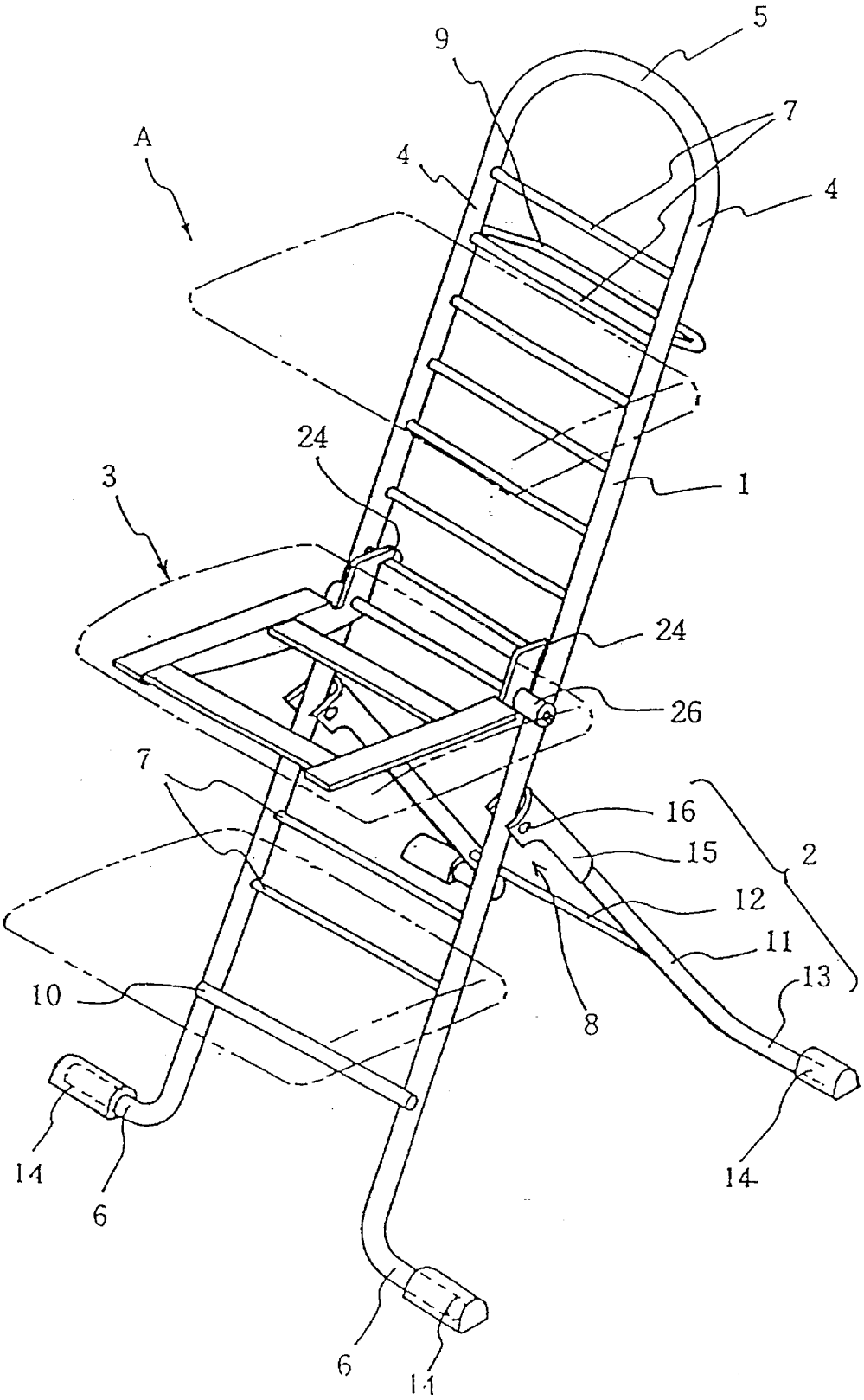
FIG.1 is a perspective view showing an embodiment of a height-adjustable folding chair according to the present invention.
Figure 2:
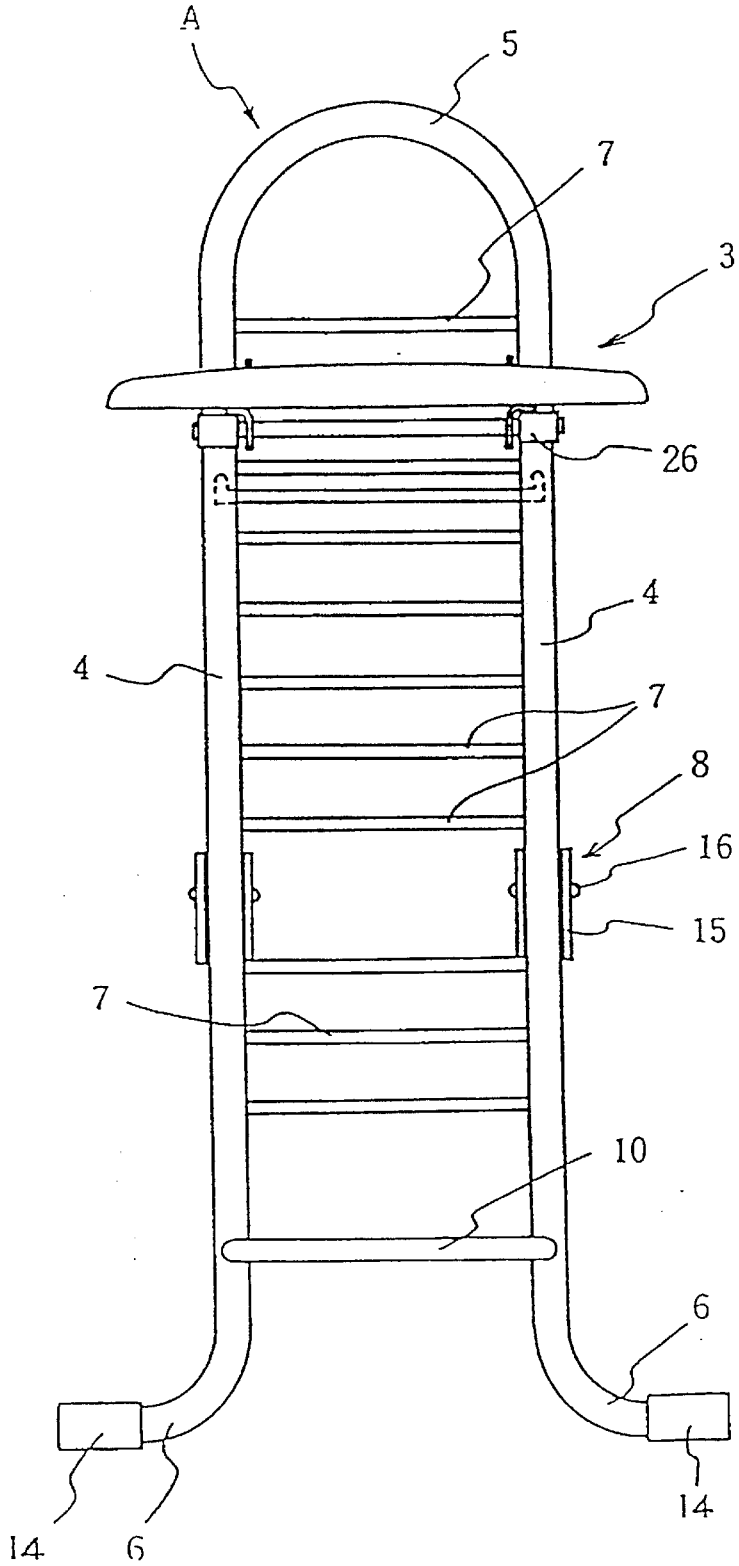
FIG. 2, FIG.3 and FIG.4 are a front view, a side view and a side view in folded state showing the chair of FIG. 1, respectively.

Referring to FIG. 1, a chair A comprises a main frame 1, an auxiliary leg 2 foldably jointed to the main frame 1 and a seat 3 detachably mounted on the main frame 1. As shown in FIG.2, the main frame 1 has a pair of left and right supporting poles 4, 4, an arc-shaped upper end portion 5 connecting the upper ends of the poles 4, 4 which are made by bending a thick metal tube into a U-shaped form. The left pole 4 and the right pole 4 are parallel with each other. Further the main frame 1 has feet 6, 6 which are bent out lower portions of the poles 4,4, and many lateral bars 7 made of straight thin metal rod or tube which are bridged between the pair of poles 4,4. The lateral bars 7 are arranged horizontally at regular intervals, and both ends of each lateral bar 7 are fixed to the poles 4, for example, by welding.

In the present embodiment, the lateral bars 7 are arranged in a wide area from a portion near the upper end portion 5 to the bottom portion without portion near the middle of the connecting portion 8 of auxiliary leg 2, as shown in FIG.2. Further, the main frame 1 has a hanging bar 9 at a position higher than the middle portion at rear side thereof. The hanging bar 9 has both bent ends which are fixed to the left and right poles 4,4 so that the hanging bar 9 bridges the poles 4,4 (see FIG. 3). The hanging bar 9 is a member to hang the seat 3 by hooking the hooks 24 mentioned after, and the hanging bar 9 and hook 24 are one of hanging means in Claim 1. The main frame 1 has also a footrest 10 made of a thin metal bar or tube. The footrest 10 is a member to put the user's feet when the seat 3 is set at high position.

Figure 3:
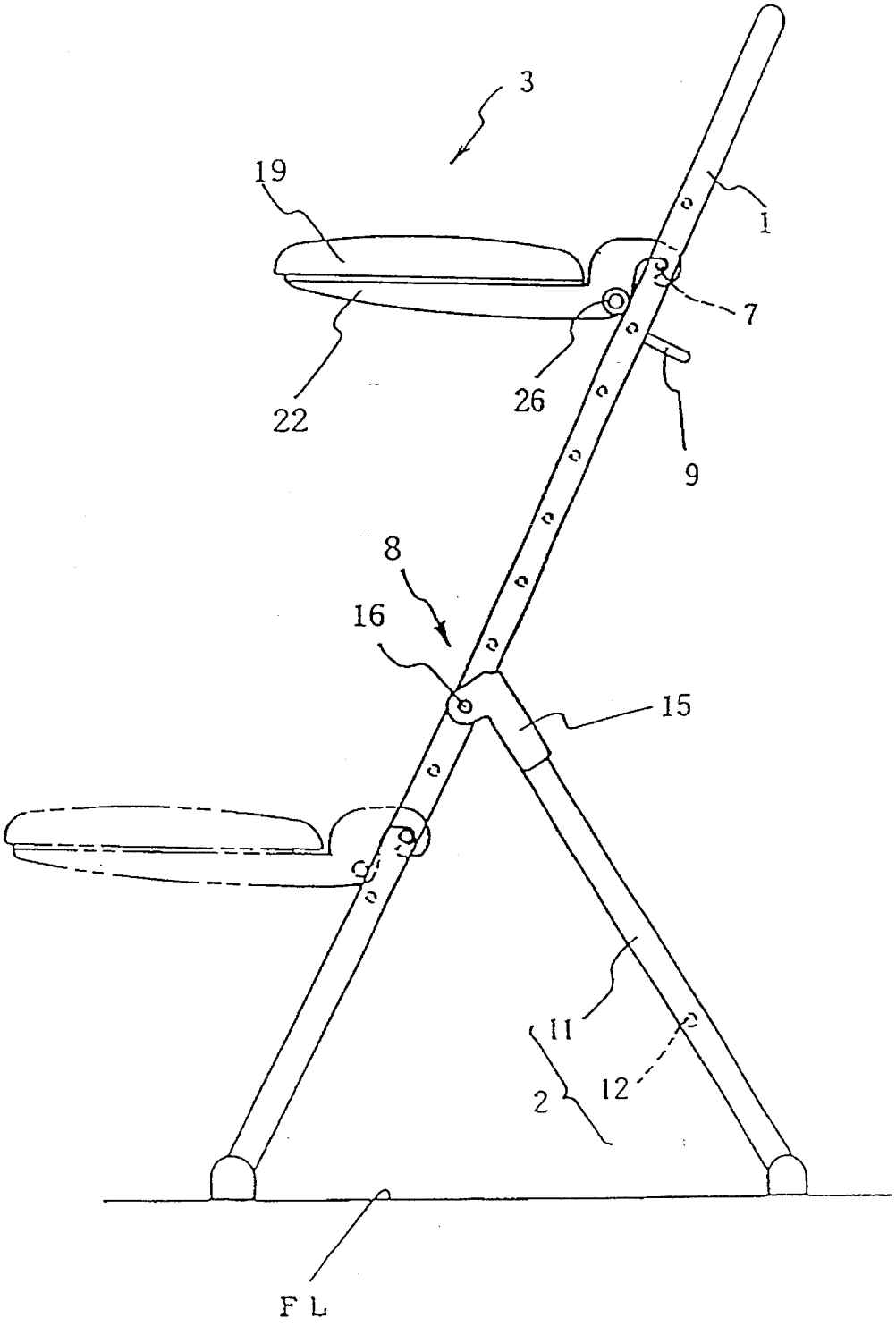

The auxiliary leg 2 has a pair of longitudinal members 11 made of thick metal tubes and a lateral member 12 made of a thin metal tube so as to form an H-shape. The lower ends of the longitudinal members 11, 11 are bent out to form feet 13,13. Each end of the feet 6 and 13 of the main frame 1 and the auxiliary leg 2 is covered with a cap 14 made of rubber or synthetic resin so as not to damage floor. A bracket 15 is fixed to the upper end of each longitudinal member 11. The bracket 15 has U-shaped form in section and is rotatably connected to the pole 4 of the main frame 1 by means of a pin 16, at a position somewhat lower than the middle of the pole 4, to make a connecting portion 8 or hinge. In the present embodiment, as shown in FIG.3, the upper end of the bracket 15 abuts against the pole 4 so as not to rotate more, when the auxiliary leg 2 is opened.

Figure 4:
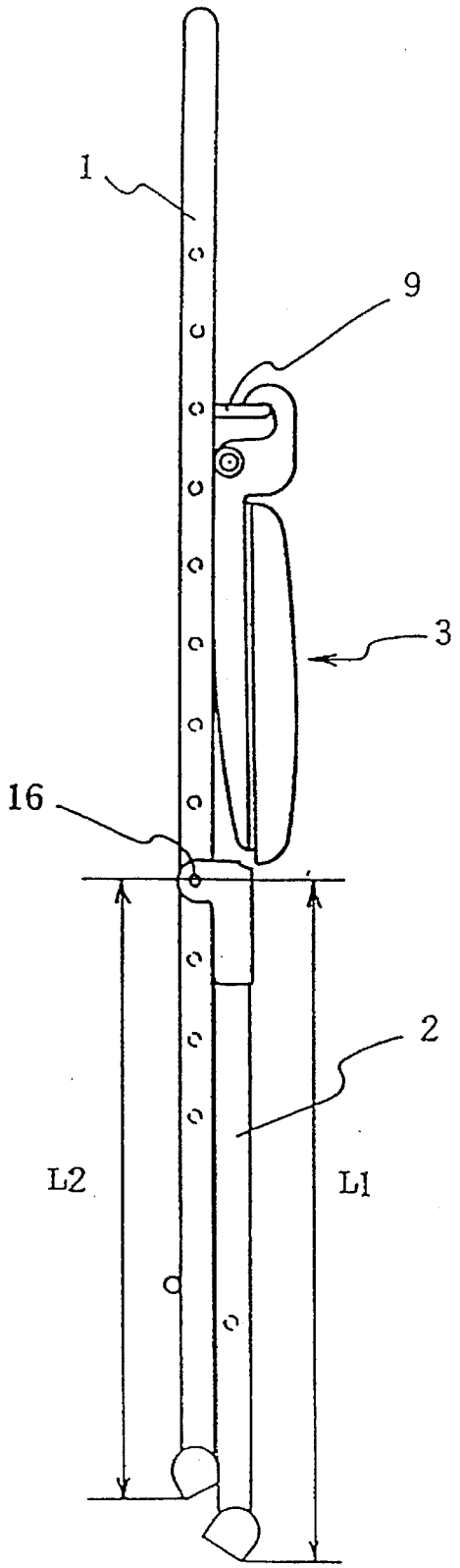

As shown in FIG.4, length L1 of the auxiliary leg 2 is longer than the length L2 from pin 16 to the lower end of the pole 4. Therefore, when if the seat 3 is set at a high position as shown in FIG.3, stability is good. The chair A of FIGS.1 and 2 is not provided with a lateral bar 7 at the position near the connecting portion 8 so that the bracket 15 do not interfere the lateral bar 7. However, the lateral bar 7 can be provided at a portion where is the bracket 15 not interfered (see FIG. 11 and FIG. 12).

Figure 5:
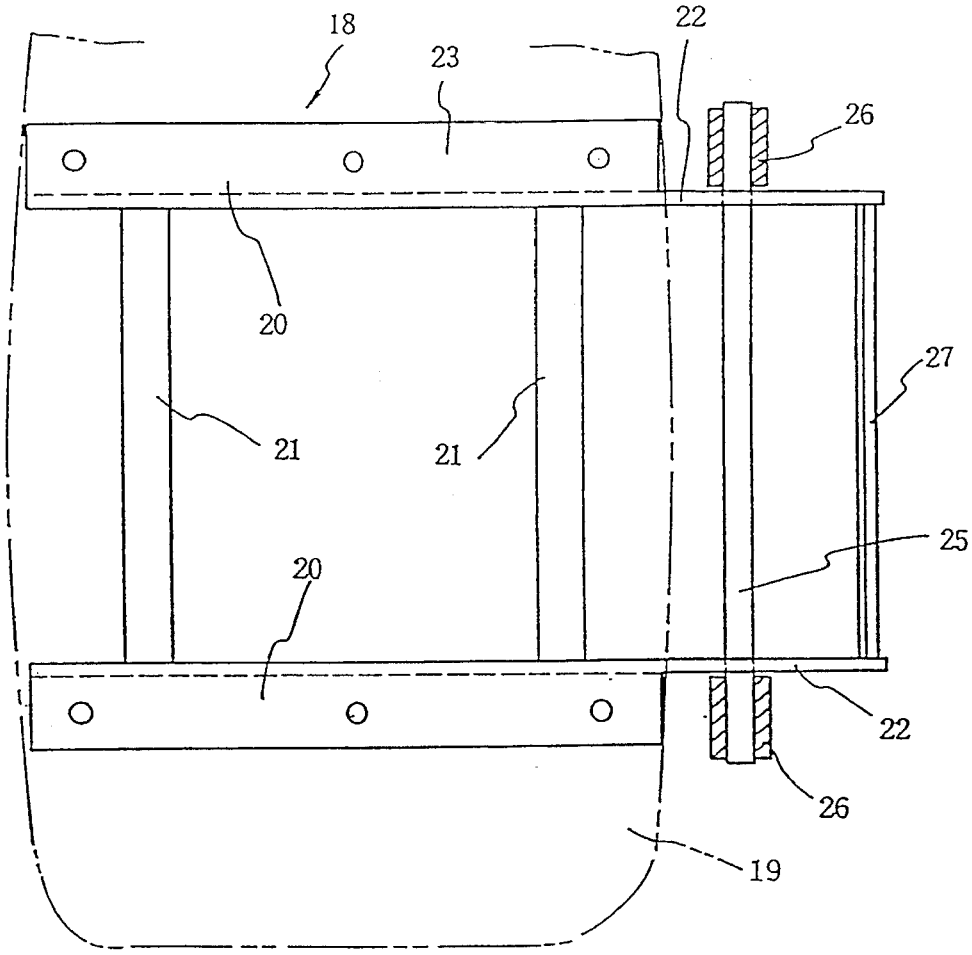
FIG.5, FIG.6 and FIG.7 are a plan view, a side view and a front view showing an embodiment of a seat according to the present invention, respectively.

Referring to FIG.5, the seat 3 has a metal framework 18 and a cushion 19 mounted on the framework as a seat body.

In stead of the cushion 19, a metal sheet, mesh sheet and the like might be mounted on the framework 18. The framework 18 has two supporting bars 20, 20 arranged in the front-to-rear direction of the chair and lateral members 21, 21 for connecting mutually the front ends of the supporting bars 20 and mutually the rear portions of the supporting bars 20.

Figure 6:
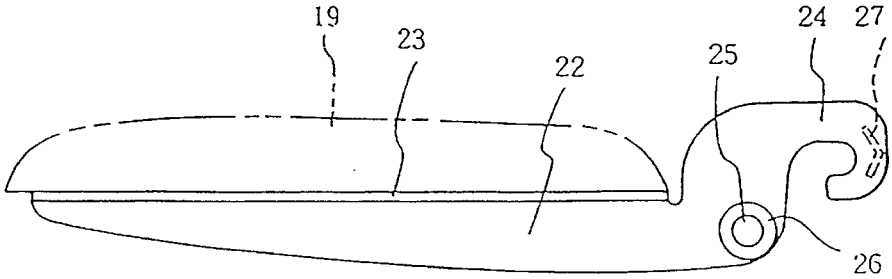
Figure 7:
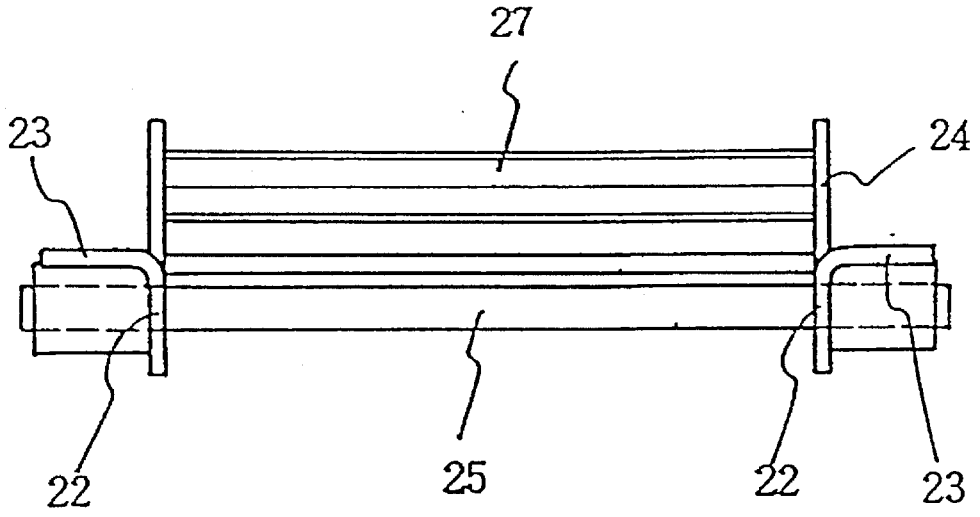

As shown in FIGS. 6 and 7, each of left and right supporting bars 20 is made of a metal sheet partially bent in L-shaped cross section. That is to say, the supporting bar 20 has a vertical rib 22 and a horizontal rib 23 extending outward from the upper end of the vertical rib 22. The rear end of the vertical rib 22 curves upward, extends in the rear direction, and curves downward. Then the free end extends in the front direction to form a hook 24. As seen in FIG. 6, the hook 24 has generally the shape of a letter J or U, and the interior surface of the hook 24 is rounded into a generally circular arc. The vertical rib 22 and the horizontal rib 23 might be connected to form T-shaped cross section. Further, the hook 24 might be provided on the rear end of the horizontal rib 23 by extending and bending the rear end of the horizontal rib 23.

As shown in FIG.5, a metal pipe or rod 25 is fixed to the vertical ribs 22 at a lower position near the rear end, so that the rod 25 passes through the both vertical ribs 22. Both free ends of the rod 25 project from the vertical rib 22, and those projecting portions are covered with stoppers 26 made of rubber or synthetic resin. Such rubber and synthetic resin are preferably elastomeric material having good elasticity in order to improve comfortableness and to moderate impact force, for example, when the user sits out it. Further, when a synthetic resin is used, synthetic resin having the same strength and endurance as a hard rubber is preferably employed. The both ends of rod 25 are abutting portion, and the stopper 26 is an abutting member in claims. A reinforcement member 27 made of a metal sheet having an L-shaped cross section is interposed between the roots of the hook 22. The reinforcement member 27 prevents the hooks 24 from bending even if the hook 24 receives side force.

In use of the above-mentioned chair A, at first, the auxiliary leg 2 is opened and the chair A is stood on a floor FL or the like by virtue of the feet 6 of the poles 4, 4 and the feet 13, 13 of the auxiliary leg 2. Then the lower parts of the poles 4 become front legs and the auxiliary leg 2 becomes rear legs. The upper part of the main frame 1 including lateral bars 7 can be used as a backrest on demand.

Next, the seat 3 is mounted on the main frame 1 from the front side. The hooks 24 are inserted between a pair of selected lateral bars 7 so as to project to the rear side -of the main frame 1. Then the hooks 24 are hooked on a lateral bar 7, and the seat 3 is inclined forward. Further, the stoppers 26 are abutted against the surface of the poles 4. Then the seat 3 can be securely supported in substantially horizontal state.

Figure 8:
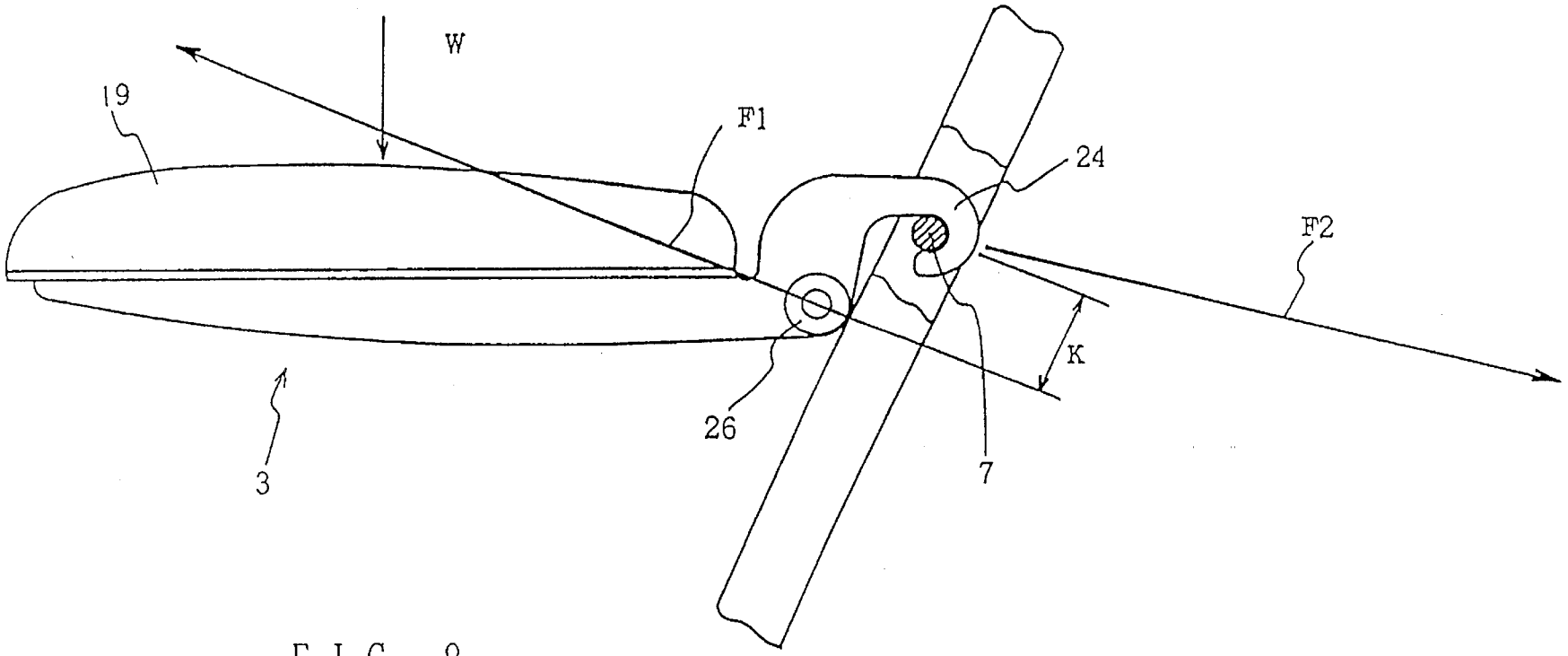
FIG.8 is an illustration showing a balance of forces about a seat in the present invention.

It can be thought that the body weight W of user is supported at a center of the cushion 19 as shown in FIG.8. And the weight W is supported by a reaction component F1 which the stopper 2 receives from the surface of the pole 4 and another reaction component F2 which the hook 24 receives from the lateral bar 7. Those reaction components F1 and F2 become several times of the weight W. However, such reaction components F1 and F2 can be reduced by elongating the interval K between the hook 24 and the stopper 26.

In the chair mentioned in U. S. Pat. No. 4,793,654, the seat is supported by friction between stoppers and poles, with utilizing leverage effect when the seat is rotated. Therefore, the interval between the front stoppers and rear stoppers cannot be elongated in the conventional chair.

On the contrary, in the present invention, the interval K between the hook 24 and the stopper can be elongated since the hook 24 is hooked on the lateral bar 7. Further, the distance K is preferably enlarged since large distance K causes small pressing force applied to the lateral bar 7 and the hook 24. Though directions of the force somewhat changes according to sitting position of the user, the lateral bar 7 receives forces in the same direction substantially. Therefore, a reinforcing member such as a rib capable of supporting the forces of the direction is preferably provided to the lateral bar 7.

To change height of seat 3, the seat 3 is detached once from the main frame 1, and then the hooks 24 are hooked again to another selected lateral bar 7 which provides desired height. Height of the seat 3 can be adjusted stepwise in accordance with intervals of the lateral bars 7. That is, if the intervals are small, the seat 3 can be adjusted closely. If required, the intervals of the lateral bars 7 can be changed along the poles 4. For example, the lateral bars 7 might be arranged with high density in a required area, and with low density in another area. The intervals of lateral bars are to be selected in accordance with use of the chair.

When the chair A is folded, the seat 3 is dismounted from the front side of the main frame 1, at first. Then the seat 3 is hung on the main frame 1 by hooking the hooks 24 of the seat to the hanging bar 9 at the back of the main frame 1. Further, the auxiliary leg 2 is folded against the main frame 1. In this state, the seat 3 is stored in a space over the auxiliary leg 2. Then the thickness of the folded chair is thin.

Figure 9A:
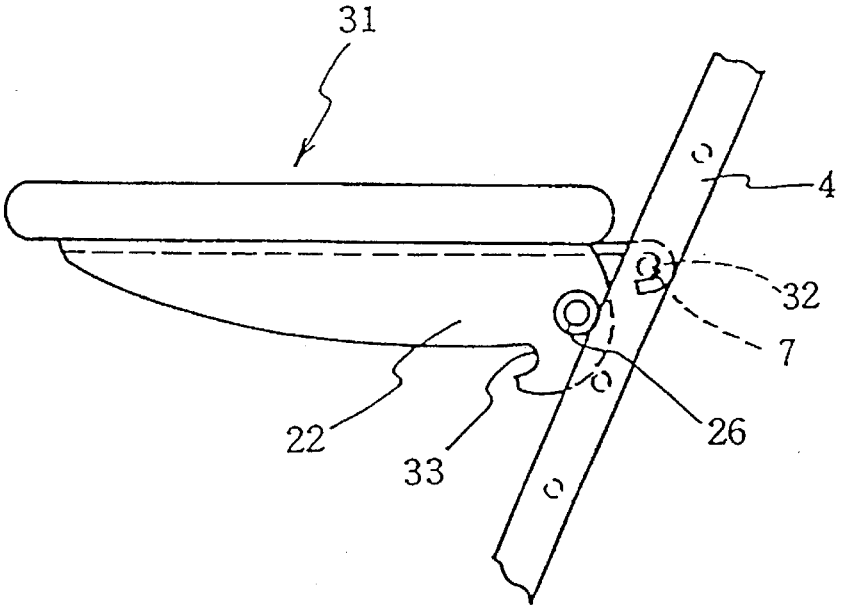
FIG. 9*a* and FIG.9*b* are side views showing another embodiment of a seat in use position and folded position.

FIG.9*a* shows another embodiment of a seat of a chair according to the present invention. The seat 31 has hooks 32 made by bending extension of supporting bars downward. Further the seat 31 has second hooks 33. The second hook 33 might be obtained by cutting the lower portion of the vertical rib 22.

Figure 9B:
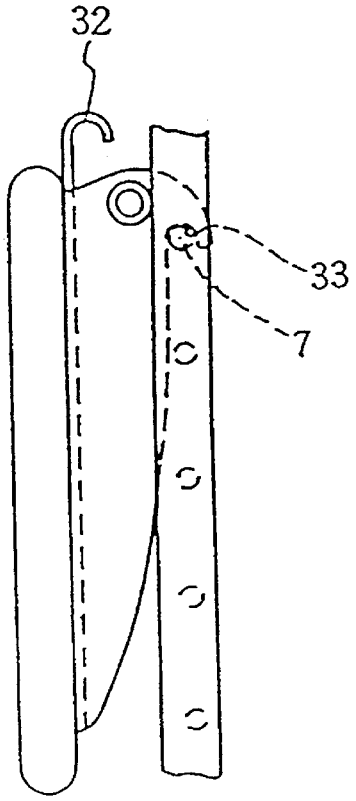

The second hook 33 can be hooked on a lateral bar 7 when the chair is folded as shown in FIG. 9*b*, since the second hooks 33 are positioned at the lower end of the vertical rib 22. Therefore, one of lateral bar 7 can be used as a hanging bar, and any additional hanging bar is not required. The seat 3 can be hung at the front side of the main frame. However, the seat 3 is generally hung at the rear side since the auxiliary leg 2 is folded on the rear side. The second hook 33 and the lateral bars 7 are the hanging means in claim 1.

Figure 10A:
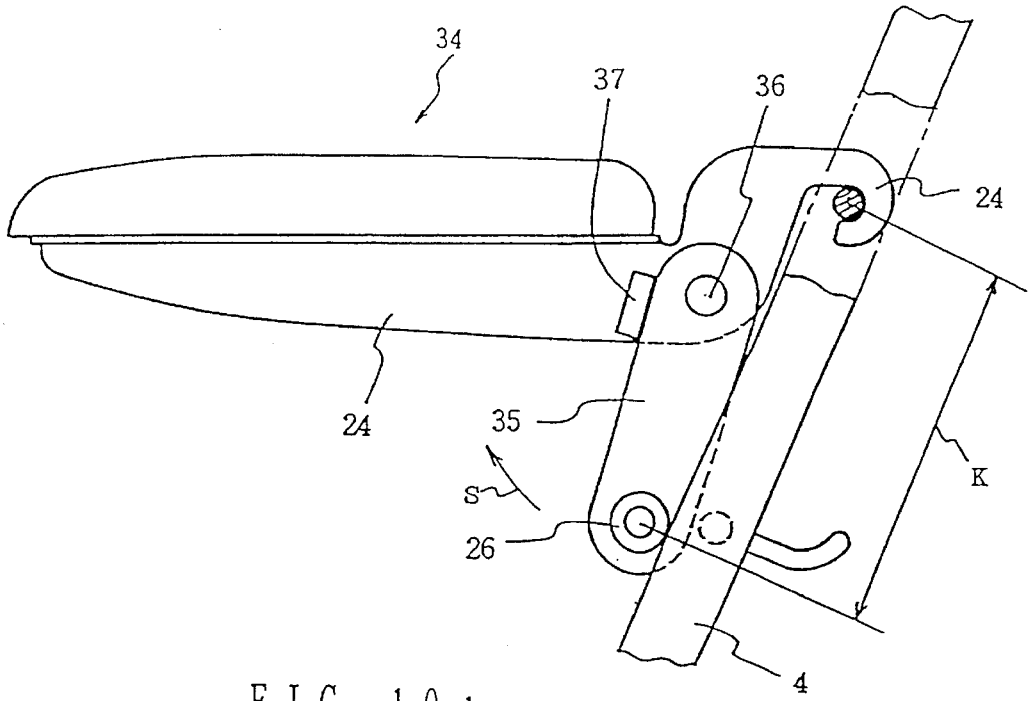
FIG. 10*a* and FIG. 10*b* are views showing further another embodiment of a seat in use position and folded position.

Referring to FIG. 10*a*, another embodiment of seat 34 has a pair of supporting members 35 each of which carries a stopper 26. The supporting member 35 extends downward from the rear end of the vertical rib 22. Therefore, distance K between the hook 24 and the stopper 26 is large, and load applied on the hook 24 and the lateral bar 7 is reduced. However, when the seat 34 is hung on a hanging bar 9 with providing the upper surface out as the same manner shown in FIG. 4, the supporting member 35 interferes with the pole 4 or the hanging bar 9 projects largely in the rear direction. Therefore, in such embodiment, the supporting member 35 is preferably rotatably connected to the vertical rib 24 by means of a pin 36 or the like so that the supporting member 35 is foldable against the vertical rib 24. Therefore, the seat 34 can be hung close to the main frame. Number 37 denotes to a stopper for checking rotation of the supporting member 35 in the direction of arrow S in use position of the seat 34. In such embodiment, though the seat 34 has long supporting member 35, the seat can be hung on a short hanging bar 9 shown in FIG. 10*b*.

Figure 10B:
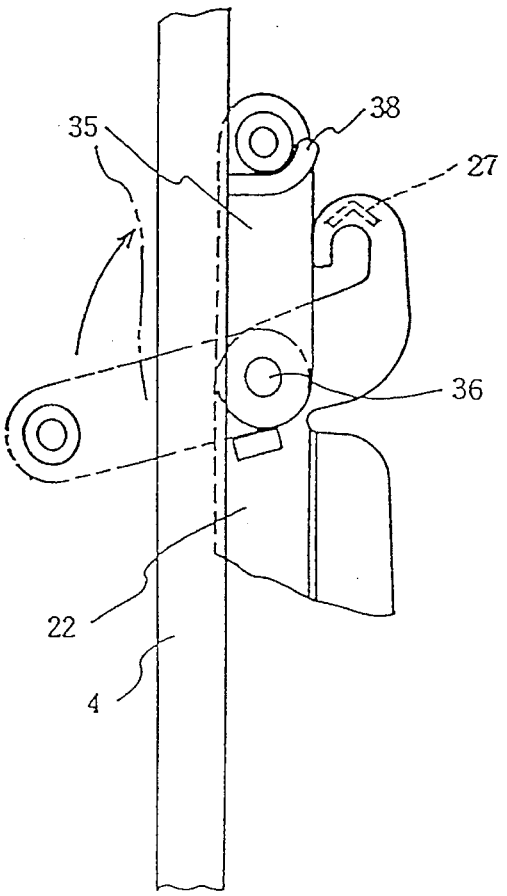

In addition, as shown in FIG. 10*b*, the seat 34 can be hung on the main frame by hooking the rubber or synthetic resin stopper 26 or the rod 25 or reinforcement member 27 on curved hanging members 38 projecting from both poles 4, since the stopper 26, the rod 25 and the reinforcement member 27 comes to upper side of the hook 24. The hook-like hanging members 38 fixed to the poles 4 and another members to be hooked on the hanging members 38 are also one of hanging means in claim 1.

Though the footrest 10 is fixed to the main frame 1 in FIG. 1, the footrest 10 might be adjustable in height like the seat 3. Further, in the above-mentioned embodiments, the upper end of the auxiliary leg 2 is rotatably connected to the middle portion of the main frame 1. However, the auxiliary leg 2 might be rotatably connected to the lower end of the main frame. In this case, the auxiliary leg is, for example, attached to the main frame so that the auxiliary leg can be folded against the pole, and the leg holds a predetermined angle against the pole when the leg is turned rear in use position. Further, the auxiliary leg might be connected to the upper end, upper portion and the like of the main frame.

In the above-mentioned embodiment, the main frame 1 has a left pole 4 and a right pole 4. However, a pair of left poles and a pair of right poles might be employed as the conventional chair (U. S. Pat. No. 4,796,654) is. In this case lateral bars might be bridged in the gap of the two left poles, and in the gap of the two right poles, respectively.

Figure 11:
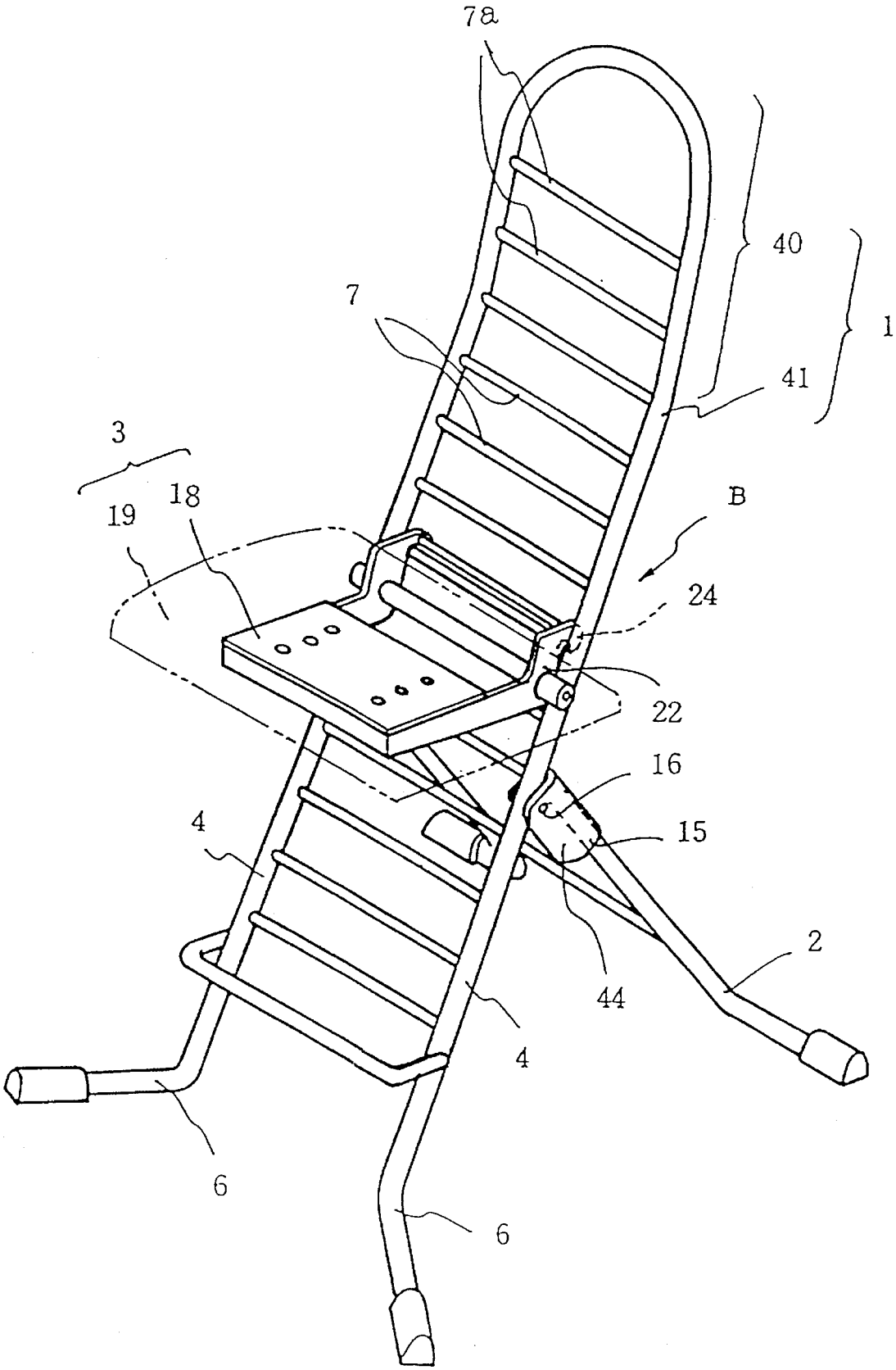
FIG. 11 is a perspective view showing another embodiment of a height-adjustable folding chair according to the present invention.

The chair B of FIG. 11 is a modification of the chair A of FIG.1. Construction of the main frame 1, the auxiliary leg 2 and the seat, and fundamental function and technical effect, that is, folding manner, adjusting in height of the seat and detaching manner of the seat from the main frame are the same as the chair a of FIG.1.

The chair B of FIG. 11 has additional characteristic features and provides following functions and technical effects. That is to say, upper portion 40 of the main frame 1 of the chair B is inclined or bent forward for angle θ to the middle area 41 as clearly shown in FIG.12. Therefore, when the hook 24 of the rear end of the seat 3 is engaged with the lateral bar 7*a* in the area of the inclined upper portion 40, the seat 3 is also inclined forward for angle θ as shown by imaginary line P1 in FIG. 12. Then a user can sit on the seat 3 with a slight slouch, and work with sitting at a desk or low work table becomes easy.

As shown in FIG.11, each of left and right poles 4 has a hoot portion 6 which is bent in the front and outward direction. Therefore, the front end 42 of the foot portion 6 comes forward than the extension line 43 of the pole. Therefore, when the seat is set at a lower position shown by imaginary line P2, the center of gravity of the user falls on a position behind the front end 42 of the foot portion 6. Then the user can sit stably at the lower position.

Further, in the chair B, the lateral bars 7 are arranged at regular intervals also in the area near the connecting portion 8. A bracket 15 having U-shaped cross section is fixed to the upper end of longitudinal bar of the auxiliary leg 2, and the bracket 15 is rotatably jointed to the pole 4 of main frame 1 at a position between two lateral bars with a pin 16. The pin 16 is inserted through the pole 4 at slightly lower position from the correct middle position between two lateral bars 7. The outer plate 44 of the bracket 16 having U-shaped cross section has substantially rectangular shape capable of covering a triangular gap between the pole 4 and the longitudinal member 11 of the auxiliary leg 2 when the auxiliary leg 2 is opened.

Therefore, when the auxiliary leg 2 is folded, anything is not easily caught between the poles 4 and the longitudinal member 11, and the safety of the chair is improved. The lower corner portion 46 of the bracket 15 is preferably round off.

Figure 12:
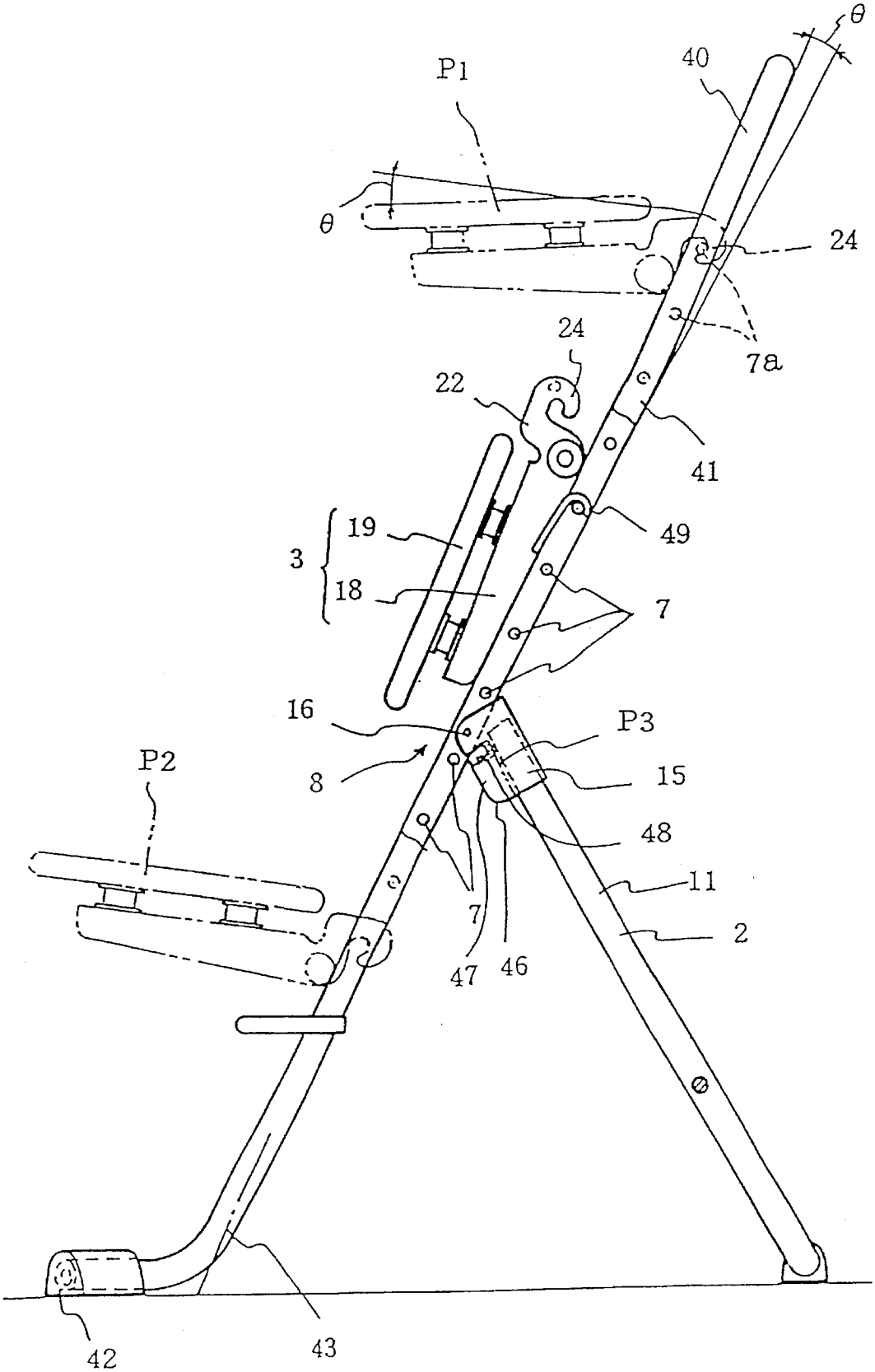
FIG. 12 is a partially-cut-off side view of the chair of FIG. 11.

Though the bracket 15 is large, interference between the bracket 15 and the lateral bar 7 can be prevented by making an arc-shaped slot 48 in an inside plate 45 of the bracket 15 as shown in FIG.12. The rectangular part under the slot 48 might be cut off as shown by imaginary line P3.

As shown in FIG.11, the seat 3 has a metal framework 18 and a cushion 19 in this chair B. And hooks 24 are made at rear extension portions of the vertical rib 22 of the framework 18. Further, a pair of second hooks 49 for hanging the seat 3 to the main frame 1 are fixed at lower surface of the vertical rib 22. Therefore, the seat 3 can be hung on the front or rear side of the main frame 1 by hooking the second hook 49 on one of lateral bars 7. The seat 3 can be hung with the upper surface out so as to obtain a good appearance in folded position.

The arrangement of the hook 24 for keeping horizontal posture of the seat 3 and the second hook 49 is the same as the hook 32 and the second hook 33 of the seat 31 in FIG.9*a*. However, the hook 24 is formed at the rear extension of the vertical rib 22 in the chair B of FIG.11, and the hook 24 is therefore has higher strength.

Figure 13:
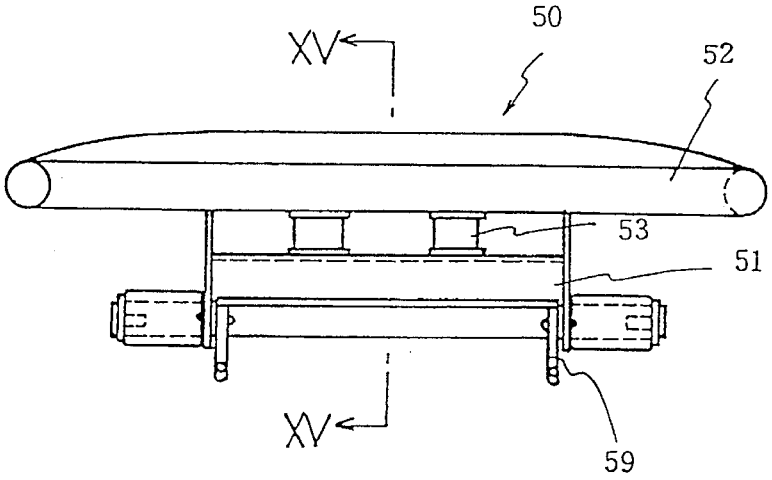
FIG.13 and FIG.14 are a front view and a bottom view, respectively, showing another embodiment of a seat in the present invention.
Figure 14:
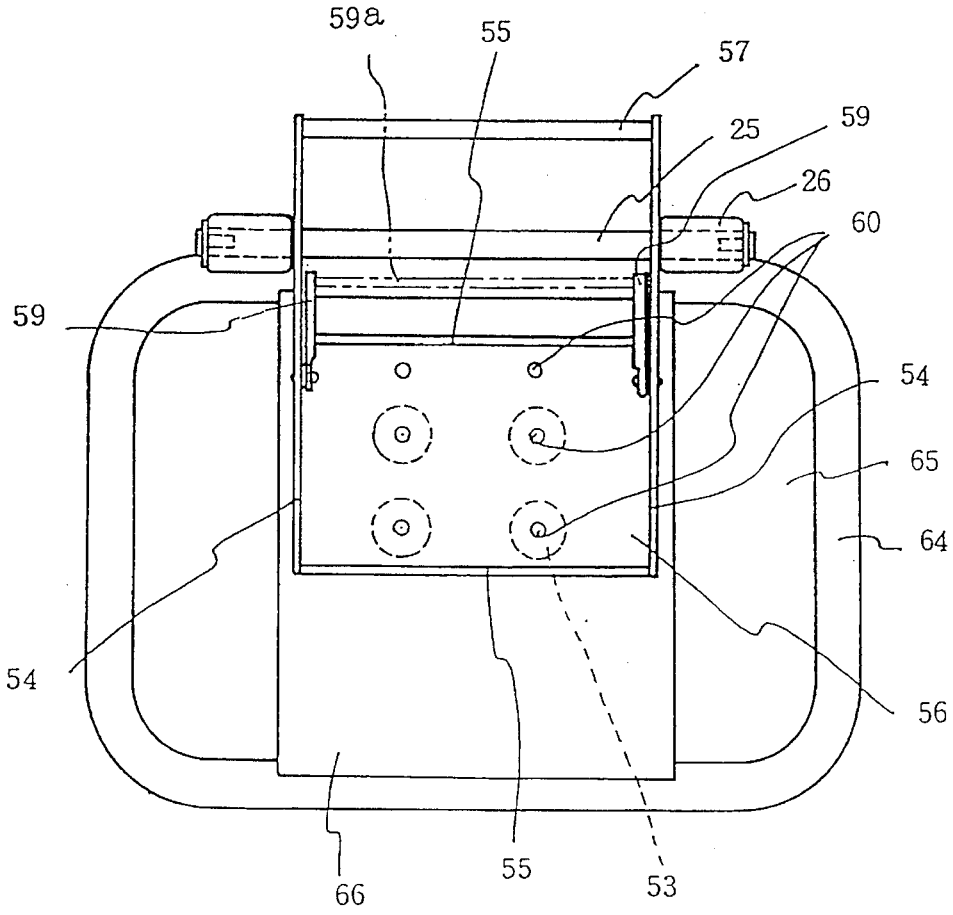
Figure 15:
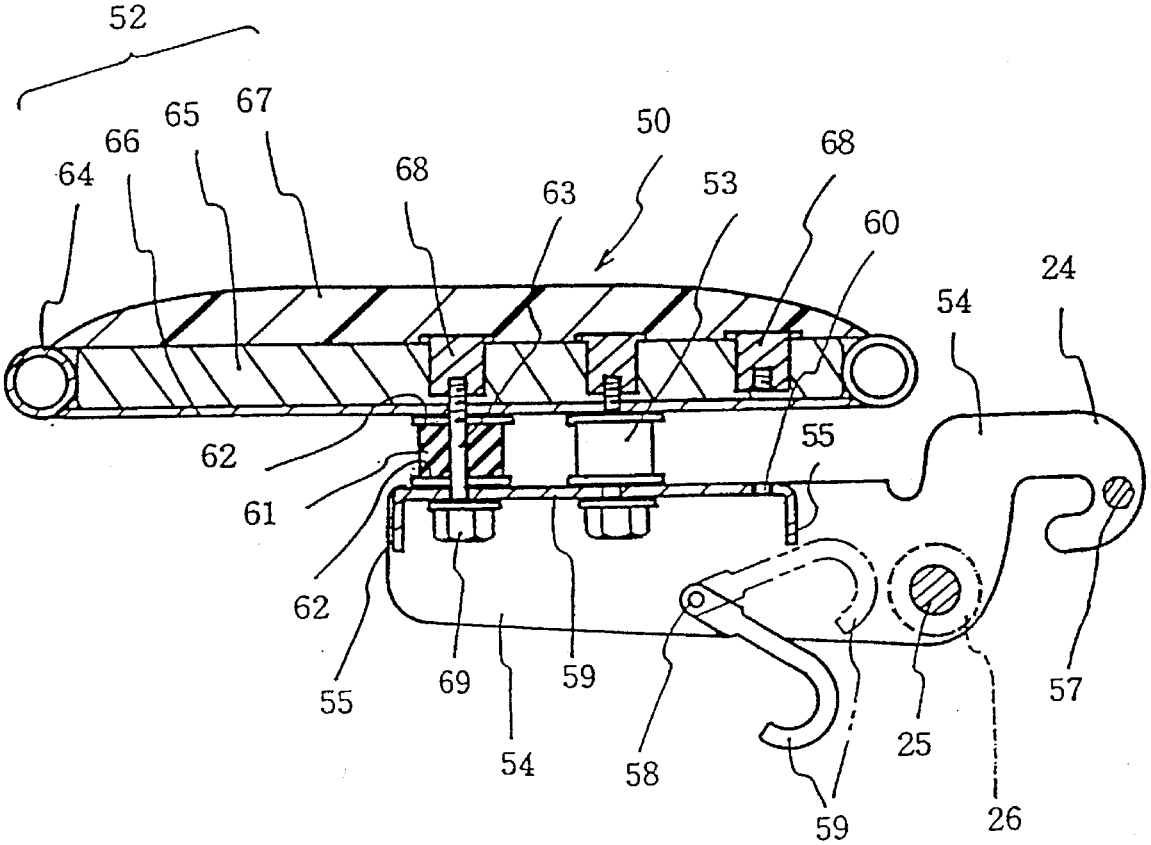
FIG. 15 is a cross sectional view along line XV—XV of FIG. 13.

FIG. 13 to 15 show another embodiment of seat. Referring to FIG. 13, the seat 50 has a metal framework 51, a seat body 52 and an elastic members 53 interposed between the seat 50 and framework 51. The elastic members 53 are mainly made of rubber or soft synthetic resin.

The framework 51 has left and right vertical ribs 54, 54, lateral ribs 55, 55 connecting the vertical ribs mutually and a sheet member 56 provided on the area enclosed the vertical ribs 54 and the lateral ribs 55. Those vertical ribs 54, the lateral ribs 55 and the sheet member 56 are jointed by welding for example.

As shown in FIG. 15, each rear end of the vertical ribs 54 has a hook 24 which is the same as the hook 24 of FIG.5. A reinforcement 57 made of metal rod is bridged between root portions of the left and right hooks 24, as shown in FIG. 14. A metal rod or tube 25 passes through the left and right vertical ribs 54 at a position near the end thereof. Both ends of the metal rod 25 are covered with stoppers 26 made of rubber or synthetic resin.

Further, second hooks 59 are rotatably connected with pins 58 at lower position of the vertical ribs 54. The second hook 58 is made by bending a metal rod, for example. In this embodiment, even if the seat 50 is erroneously fallen, the second hook 59 do not bend since the second hook 59 is pushed in the vertical rib 54 as shown by imaginary line in FIG. 15. The left and right second hooks 59 might be bridged with a bar 59*a* as shown by imaginary line in FIG. 14. In this case, the left and right second hooks 59 rotates as one body, and therefore, the seat 50 can be easily hung on the main frame (see FIG. 12).

The sheet member 56 on the vertical ribs 54 and the lateral ribs 55 has six holes 60, namely, three holes at a row and two rows as shown in FIG. 14. The elastic members 53 are attached to four holes 60 in the front side. As shown in FIG. 15, the elastic member 53 has a cylindrical rubber damper 61, disk-like washers 62 on the both ends of the damper 61 and a screw rod 63 inserted through the damper 61 and the washers 62. The screw rod 63 has thread portions at both end thereof.

Referring to FIG. 14 and FIG. 15, the seat body 52 has a rim 64 made by bending a metal tube, a veneer board 65 inserted in the rim 64, a sheet metal 66 bridged between front and rear portions of the rim 64 at the under surface thereof, and a cushion body 67 mounted on the veneer board 65. The cushion body 67 is made of foam rubber, for example. The upper end of the screw rod 63 is screwed in a nut member 68 buried in the veneer board 65, and the lower end of the screw rod 63 is inserted through the hole 60 of the sheet 56 on the framework 51 and fixed with another nut 69.

Figure 16:
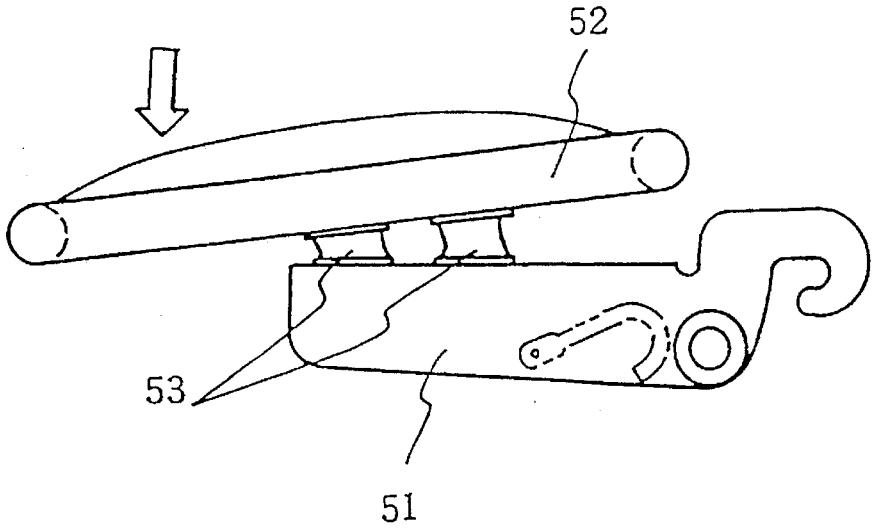
FIG. 16 and FIG. 17 are side views in use of the seat of FIG.13 to FIG.15.
Figure 17:
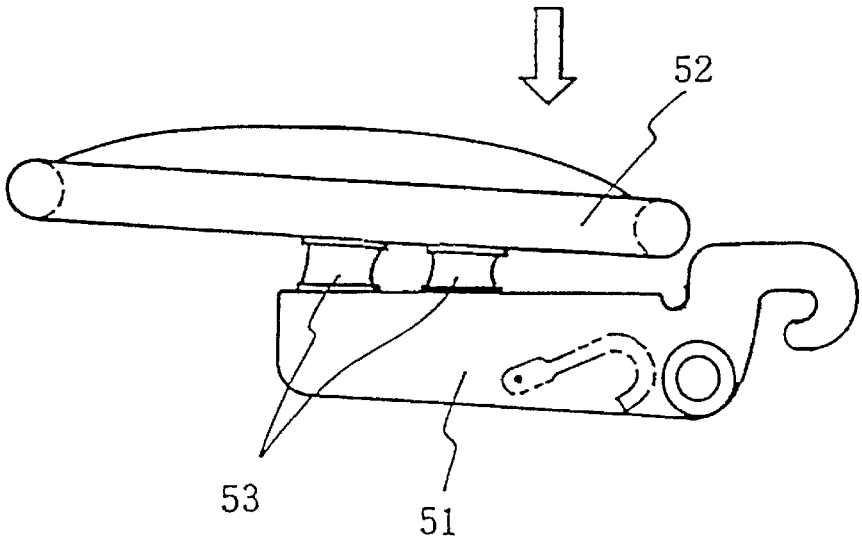

When a user sits on the seat 50 and weights front side of the seat 50, the seat body 52 is inclined forward as shown in FIG. 16, since the elastic members 53 between the framework 51 and the seat body 52 is depressed, expanded and deformed. When the user weights to the rear side of the seat 50, the seat body 52 is inclined in the rear direction as shown in FIG.17. Further, as the same manner, the seat body 52 can be inclined in the left and right directions.

Therefore, the user can easily sit in several postures on demand. Those elastic members 53 disposed with predetermined interval provide not only inclination of the seat body, but also vertical cushion effect. Further, the smaller the elastic is depressed the larger weight the elastic member 53 can supports. Therefore, the seat body 52 is inclined to an extent and do not incline more. Therefore, the user can sit comfortably and stably.

When the rear two elastic members 53 are detached from the middle holes 60 of the sheet 56, and are attached to the most rear holes 60 and are screwed in the buried nuts 68 which are not used in FIG.14 and 15, the distance between front elastic members 53 and the rear elastic members 53 is enlarged. In this state the elastic members 53 tend to receive simple compression and tension forces without receiving bending moment, when eccentric weight is applied. Therefore, inclining angle of the seat body 52 tends to be reduced, and the user can work with stable posture.

If supplemental side holes 60 and buried nuts 68 are provided in the left and right positions, the left and right inclination angle of the seat body 52 can also be adjusted.

As mentioned above, in the folding chair of the present invention, the height of seat can be easily adjusted. And the seat can be securely engaged with the main frame since hook is engaged on the lateral bars. Further, even if there is an obstacle or an area without lateral bar in the way of the main frame, the seat can be attached to a low position and a high position, since the seat is detachable.

In a chair with abutting members made of rubber or synthetic resin, the abutting members give a cushion effect and the poles of main frame can be protected from being damaged.

Though various preferable embodiments are described above with reference to the attached drawings, the present invention is not limited to the above embodiments, and various changes and modifications can be made without departing from the scope and spirit of the invention the scope and spirit of the invention mentioned in the following claims.

What I claim is:

1. A height-adjustable folding chair comprising:

(a) a main frame having at least a pair of left and right supporting poles and plural lateral bars; each lateral bar having a circular cross section and being bridged between the supporting poles;

(b) an auxiliary leg foldably connected with the main frame;

(c) a seat detachably mounted on the main frame;

(d) said seat having a pair of vertical ribs each rib having an end which has a hook curving vertically downward with a J-shape to be rotatably hooked with one of the lateral bars at a rear end thereof; and (e) said seat having a pair of left and right abutting members for abutting against surfaces of the poles so that the seat hooked with the lateral bar can be supported at a substantially horizontal angle;

(f) a means for hanging the seat on the main frame in a folded position of the chair; and (g) said lateral bars being arranged with intervals larger than a height of the hook.

2. The chair according to claim 1, wherein the abutting members are lateral rods projecting from the vertical ribs; and each lateral rod is covered with an elastomeric material.

3. The chair according to claim 1, wherein the seat has a framework and a seat body attached on the framework;

the framework has a pair of left and right supporting bars extending in a front-and-rear direction and lateral members connecting the supporting bars mutually; and each supporting bar has one of the vertical ribs provided with the hook at a rear end thereof.

4. The chair according to claim 3, wherein said supporting bar has a horizontal rib to which the seat body is attached.

5. The chair according to claim 1, wherein the seat has a lateral rod which passes through the left and right vertical ribs at lower portions so that both free ends of the lateral rod project from the vertical ribs as said pair of abutting members; and elastomeric materials are fixed on the free ends of the lateral rod.

6. The chair according to claim 1, wherein said main frame has an upper portion which is inclined forward slightly to a middle portion thereof, and; at least one of said lateral bars is arranged at the upper portion.

7. The chair according to claim 1, wherein lower portions of the left and right supporting poles are bent in forward directions so that lower ends are situated at a fore side from an imaging plane formed by the pair of supporting poles.

8. A height-adjustable folding chair comprising:

(a) a main frame having at least a pair of left and right supporting poles and plural lateral bars bridged between the supporting poles;

(b) an auxiliary leg foldably connected with the main frame;

(c) a seat detachably mounted on the main frame;

(d) said seat having a hook to be hooked with one of the lateral bars at a rear end thereof and having an abutting portion for abutting against a surface of the poles so that the seat hooked with the lateral bar can be supported in a substantially horizontal angle;

(e) a means for hanging the seat on the main frame in a folded position of the chair; wherein the seat has a framework and a seat body attached on the framework; wherein the framework has a pair of left and right supporting bars each supporting bar including a vertical rib and extending in a front-and-rear direction and lateral members connecting the supporting bars mutually; and each supporting bar is provided with the hook at a rear end thereof; and a reinforcing member is bridged between the rear ends of the vertical ribs in order to reinforce the hooks.

9. A height-adjustable folding chair comprising:

(a) a main frame having at least a pair of left and right supporting poles and plural lateral bars bridged between the supporting poles;

(b) an auxiliary leg foldably connected with the main frame;

(c) a seat detachably mounted on the main frame;

(d) said seat having a hook to be hooked with one of the lateral bars at a rear end thereof and having an abutting portion for abutting against a surface of the poles so that the seat hooked with the lateral bar can be supported in a substantially horizontal angle;

(e) a means for hanging the seat on the main frame in a folded position of the chair; wherein the hanging means comprises the hook of the seat and a hanging bar fixed to a back side of the main body so that the hook can be hooked on the hanging bar with an upper surface of the seat out.

10. A height-adjustable folding chair comprising:

(a) a main frame having at least a pair of left and right supporting poles and plural lateral bars bridged between the supporting poles;

(b) an auxiliary leg foldably connected with the main frame;

(c) a seat detachably mounted on the main frame;

(d) said seat having a hook to be hooked with one of the lateral bars at a rear end thereof and having an abutting portion for abutting against a surface of the poles so that the seat hooked with the lateral bar can be supported in a substantially horizontal angle;

(e) a means for hanging the seat on the main frame in a folded position of the chair; wherein the hanging means comprises one of the lateral bars of the main frame and a second hook attached to the seat so that the seat can be hooked along the main frame with an upper surface of the seat out.

11. The chair according to claim 10, wherein the second hook is rotatably attached to the seat.

12. A height-adjustable folding chair comprising:

(a) a main frame having at least a pair of left and right supporting poles and plural lateral bars bridged between the supporting poles;

(b) an auxiliary leg foldably connected with the main frame;

(c) a seat detachably mounted on the main frame;

(d) said seat having a hook to be hooked with one of the lateral bars at a rear end thereof and having an abutting portion for abutting against a surface of the poles so that the seat hooked with the lateral bar can be supported in a substantially horizontal angle;

(e) a means for hanging the seat on the main frame in a folded position of the chair; and wherein (f) the seat has a framework and a seat body attached on the framework through an elastic member which allows inclination of the seat body relative to the framework.

* * * * *